US008887351B2

(12) United States Patent
Vanderlinden

(10) Patent No.: US 8,887,351 B2
(45) Date of Patent: Nov. 18, 2014

(54) SWEEPING BROOM APPARATUS HAVING A SURFACE TRACKING AIR BLAST NOZZLE

(76) Inventor: Roger P. Vanderlinden, Burlington (CA)

( * ) Notice: Subject to any disclaimer, the term of this patent is extended or adjusted under 35 U.S.C. 154(b) by 629 days.

(21) Appl. No.: 12/238,364

(22) Filed: Sep. 25, 2008

(65) Prior Publication Data

US 2009/0083934 A1 Apr. 2, 2009

Related U.S. Application Data

(60) Provisional application No. 60/975,041, filed on Sep. 25, 2007.

(51) Int. Cl.
*E01H 1/08* (2006.01)

(52) U.S. Cl.
USPC ..... 15/340.3; 15/345

(58) Field of Classification Search
USPC ..... 15/340.1, 341.3, 345, 346, 78, 340.4
See application file for complete search history.

(56) References Cited

U.S. PATENT DOCUMENTS

| | | | | |
|---|---|---|---|---|
| 4,754,521 | A * | 7/1988 | Zoni | 15/340.1 |
| 6,122,797 | A * | 9/2000 | Vanderlinden | 15/346 |
| 6,154,922 | A * | 12/2000 | Vanderlinden | 15/346 |
| 6,195,836 | B1 * | 3/2001 | Vanderlinden | 15/340.3 |
| 6,195,837 | B1 * | 3/2001 | Vanderlinden | 15/348 |
| 7,281,296 | B2 * | 10/2007 | Strauser | 15/348 |
| 2007/0143950 | A1 * | 6/2007 | Lin | 15/319 |

* cited by examiner

*Primary Examiner* — Dung Van Nguyen

(57) ABSTRACT

A sweeping broom apparatus for use with a vehicle comprises a main body with a debris receiving inlet, and a broom shroud with an open bottom. Airflow obstructing flaps are disposed around the bottom edge of the broom shroud. A forwardly facing debris outlet in the broom shroud permits the directed egress of debris therefrom as a forwardly propelled stream of debris. A main sweeping broom is mounted within the broom shroud for propelling debris forwardly, thereby creating a stream of debris propelled forwardly through the forwardly facing debris outlet. An air blast nozzle is connected in fluid communication to a source of compressed air for receiving compressed air therefrom. There is a nozzle mount for mounting the air blast nozzle for movement between a lower position whereat the air blast nozzle is disposed adjacent the surface being cleaned and to emit air in a forward and downward direction to impact on the surface being cleaned, and a raised impact-absorbing position. There is also a biasing spring for biasing the air blast nozzle to the lower position.

7 Claims, 4 Drawing Sheets

SWEEPING BROOM APPARATUS HAVING A SURFACE TRACKING AIR BLAST NOZZLE

This application is a non-provisional application claiming priority from U.S. Provisional Patent Application Ser. No. 60/975,041 filed on Sep. 25, 2007, which is herein incorporated by reference.

FIELD OF THE INVENTION

The present invention relates to street sweeping vehicles, and more particularly to dustless street sweeping vehicles.

BACKGROUND OF THE INVENTION

Conventional street sweepers have a main vehicle body and a hopper supported by the main vehicle body. In mechanical type street sweepers, there is a debris elevator at the back end of the vehicle. A large cylindrically shaped rotating sweeping broom is disposed immediately behind the elevator. The large cylindrically shaped sweeping broom contacts the surface being cleaned so as to propel debris forwardly to the elevator. The debris elevator receives debris from a main sweeping broom and deposits the debris into the hopper.

Similarly, for re-circulating types street sweepers and vacuum type street sweepers, a large cylindrically shaped sweeping broom is commonly used in conjunction with air flow to remove debris from a surface being cleaned.

In some street sweepers, there is an air blast nozzle disposed immediately rearwardly of the sweeping broom and aimed at or immediately behind the area of contact of the broom with the surface being cleaned. Preferably, the air blast nozzle is disposed in close relation to the surface being cleaned in order to be as effective as possible; however, it is detrimental to have the air blast nozzle too close to the surface being cleaned since the air blast nozzle may readuly become damaged. As the street sweeper travels over a surface being cleaned, such as a road or the like, the air blast nozzle is subjected to the undulations in the road, and also can impact on rocks or other objects on the surface being cleaned, thus potentially causing damage, which is highly undesirable.

It is an object of the present invention to provide a sweeping broom apparatus wherein the air blast nozzle is independently suspended on the broom shroud so as to move upwardly in response to contact with the surface being cleaned and objects thereon.

SUMMARY OF THE INVENTION

In accordance with one aspect of the present invention there is disclosed a novel sweeping broom apparatus for use with a vehicle. The sweeping broom apparatus comprises a main body having a debris receiving inlet and a connecting means for operatively connecting the main body to a vehicle. A broom shroud has an open bottom defined by a bottom edge, and has a front end and a back end, and defining a longitudinal horizontal axis extending between the front end and the back end. An airflow obstructing means is disposed around the bottom edge of the broom shroud for substantially obstructing the egress of air from between the bottom edge of the broom shroud and the surface being cleaned. There is a forwardly facing debris outlet in the broom shroud for permitting the directed egress of debris therefrom as a forwardly propelled stream of debris. A main sweeping broom is mounted within the broom shroud for propelling debris forwardly from the surface being cleaned generally along the longitudinal horizontal axis, thereby creating a stream of debris propelled forwardly through the forwardly facing debris outlet. An air blast nozzle is connected in fluid communication to a source of compressed air for receiving compressed air therefrom. There is a nozzle mounting means for mounting the air blast nozzle for movement between a lower position whereat the air blast nozzle is disposed adjacent the surface being cleaned and to emit air in a forward and downward direction to impact on the surface being cleaned, and a raised impact-absorbing position. There is also a biasing means for biasing the air blast nozzle to the lower position.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the sweeping broom apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
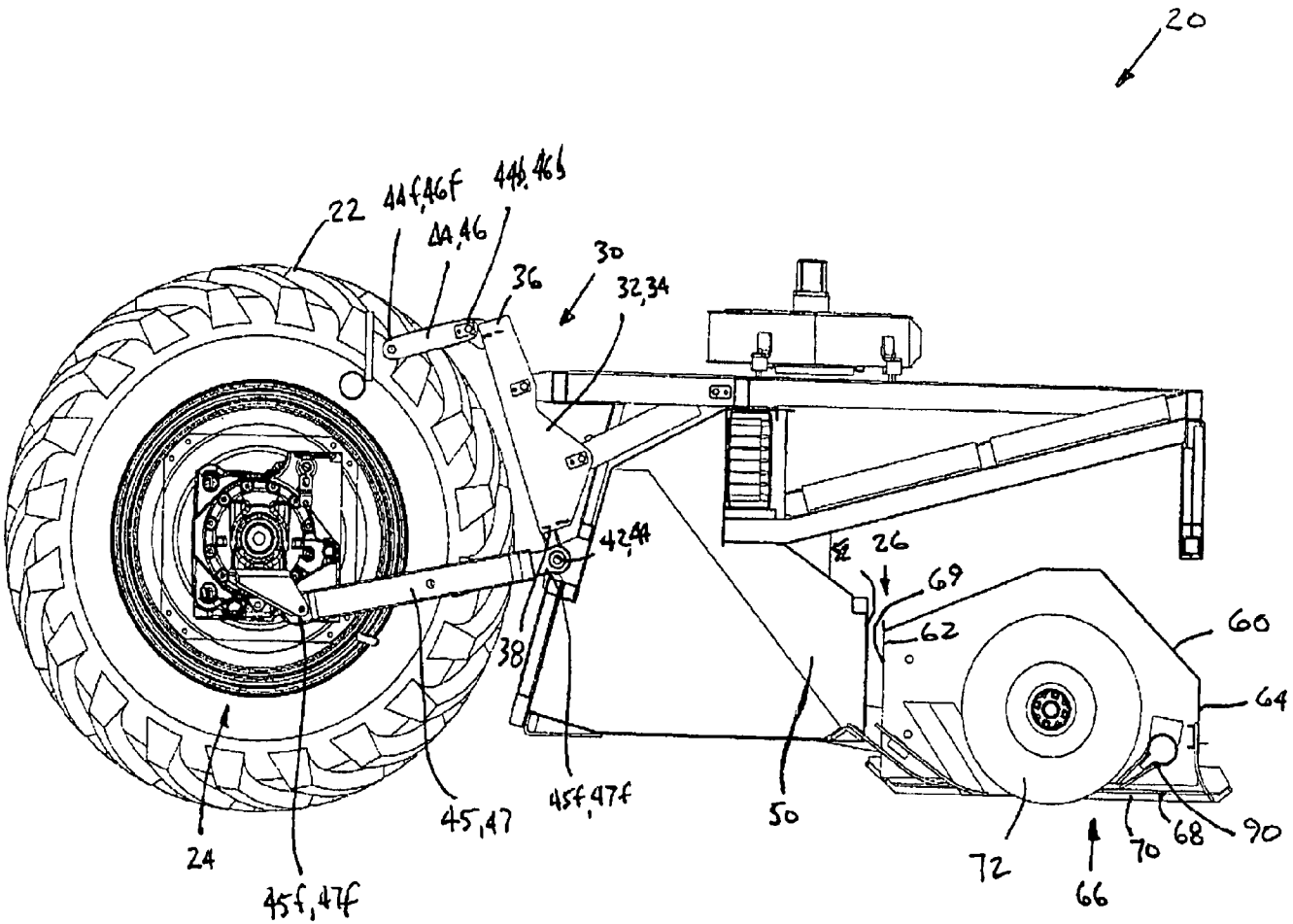
FIG. 1 is a partially cut-away left side elevational view of the first preferred embodiment of the sweeping broom apparatus according to the present invention.
Figure 2:
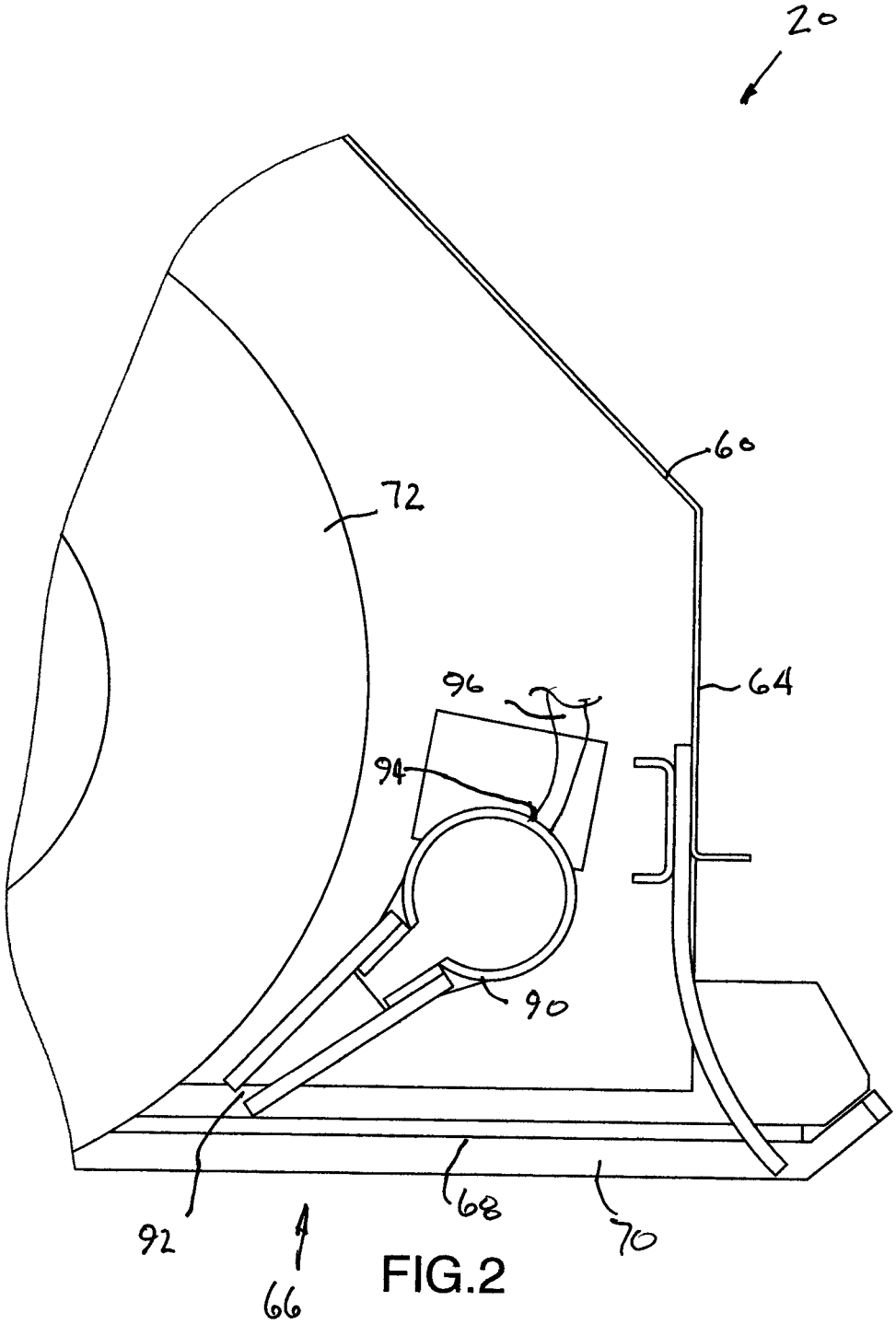
FIG. 2 is an enlarged partially cut-away left side elevational view from the right of the first preferred embodiment of the sweeping broom apparatus of FIG. 1.

Reference will now be made to FIGS. 1 through 4, which show a preferred embodiment of the sweeping broom apparatus of the present invention, as indicated by general reference numeral 20. The sweeping broom apparatus 20 is for use with a vehicle, such as a tractor 22, which is only partially shown. The tractor has a three point hitch 24 for receiving the sweeping broom apparatus 20 in supported relation thereon.

The sweeping broom apparatus 20 comprises a main body 21 having a debris receiving inlet 52 for receiving debris thereinto. There is also connecting means, as indicated by general reference numeral 30, for operatively connecting the sweeping broom apparatus 20 in trailing relation to the vehicle, such that the sweeping broom apparatus 20 is received in supported relation on the pair of rearwardly extending mounting arms 23 of the three point hitch 24. The connecting means 30 comprises a generally vertically oriented base member 30 having left and right generally vertically oriented side members 32, 34 and upper and lower cross members 36, 38. A pair of opposed spindles 40, 42 are disposed at the bottom of the generally vertically oriented base member 30. A pair of forwardly extending lower arm members 45, 47 are connected in pivoting relation at their respective back ends 45*b*, 47*b* to the opposed spindles 40, 42. The front ends 45*f*, 47*f* of the forwardly extending lower arm members 45, 47 are connectable to the tractor 22. A pair of forwardly extending upper arm members 44, 46 are connected in pivoting relation at their respective back ends 44*b*, 46*b* to a pair of co-operating flanges 48, 49 that extend forwardly from the upper cross member 36. The front ends 44*f*, 46*f* of the forwardly extending upper arm members 44, 46 are connectable to the tractor 22.

The sweeping broom apparatus 20 comprises a debris receiving hopper 50 disposed at the front of the sweeping broom apparatus 20. In the first preferred embodiment, the rearwardly facing debris receiving inlet 52 is in the debris receiving hopper 50.

A broom shroud 60 is disposed rearwardly of the debris receiving hopper 50, and is connected to the debris receiving hopper 50 by means of left and right connecting arms 54, 56. In this manner, the broom shroud 60 is vertically movable with respect to the hopper 50. Accordingly, a small gap 26 exists between the debris receiving hopper 50 and the broom shroud 60. The broom shroud 60 has a front end 62, a back end 64, an open bottom 66 defined by a bottom edge 68, and a forwardly facing debris outlet 69 for permitting the directed egress of debris therefrom as a forwardly propelled stream of debris.

An airflow obstructing means 70 is disposed around the bottom edge of the broom shroud 60 for substantially obstructing the egress of air from between the bottom edge of the broom shroud 60 and a surface being cleaned 29. The airflow obstructing means 70 comprises a series of overlapping rubber flaps 70 depending from the bottom edge 68 of the broom shroud 60.

A main sweeping broom 72 is operatively mounted within the broom shroud 60 for propelling debris forwardly from a surface being cleaned 29, thereby creating a stream of debris propelled forwardly through the forwardly facing debris outlet 69 directly to the rearwardly facing debris receiving inlet 52 of the debris receiving hopper 50.

Figure 3:
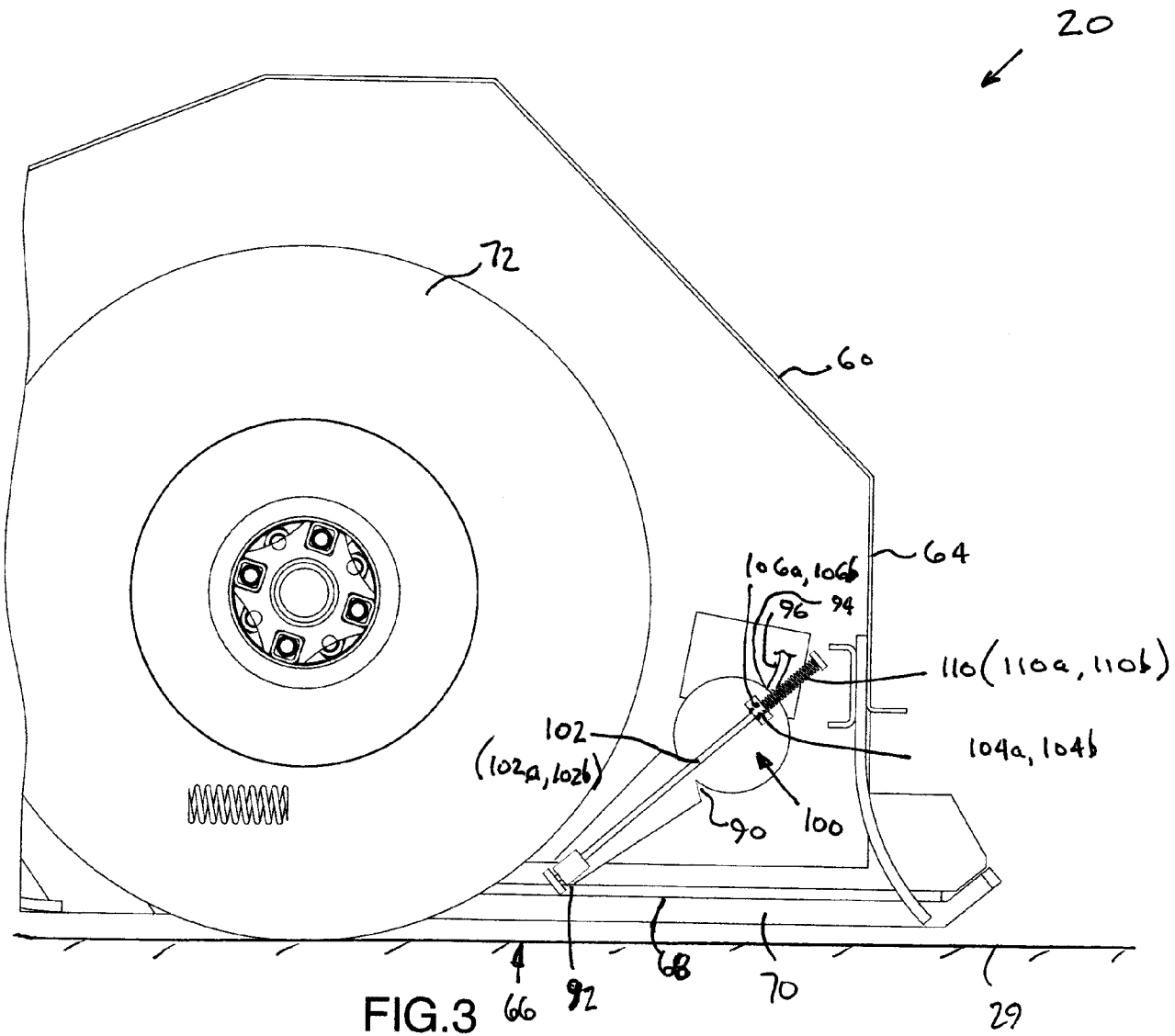
FIG. 3 is an enlarged partially cut-away left side elevational view similar to FIG. 2, but with the air blast nozzle and mount shown, and with the air blast nozzle in its lower position; and, FIG. 4 is an enlarged partially cut-away left side elevational view similar to FIG. 3, but with the air blast nozzle in its lower position.
Figure 4:
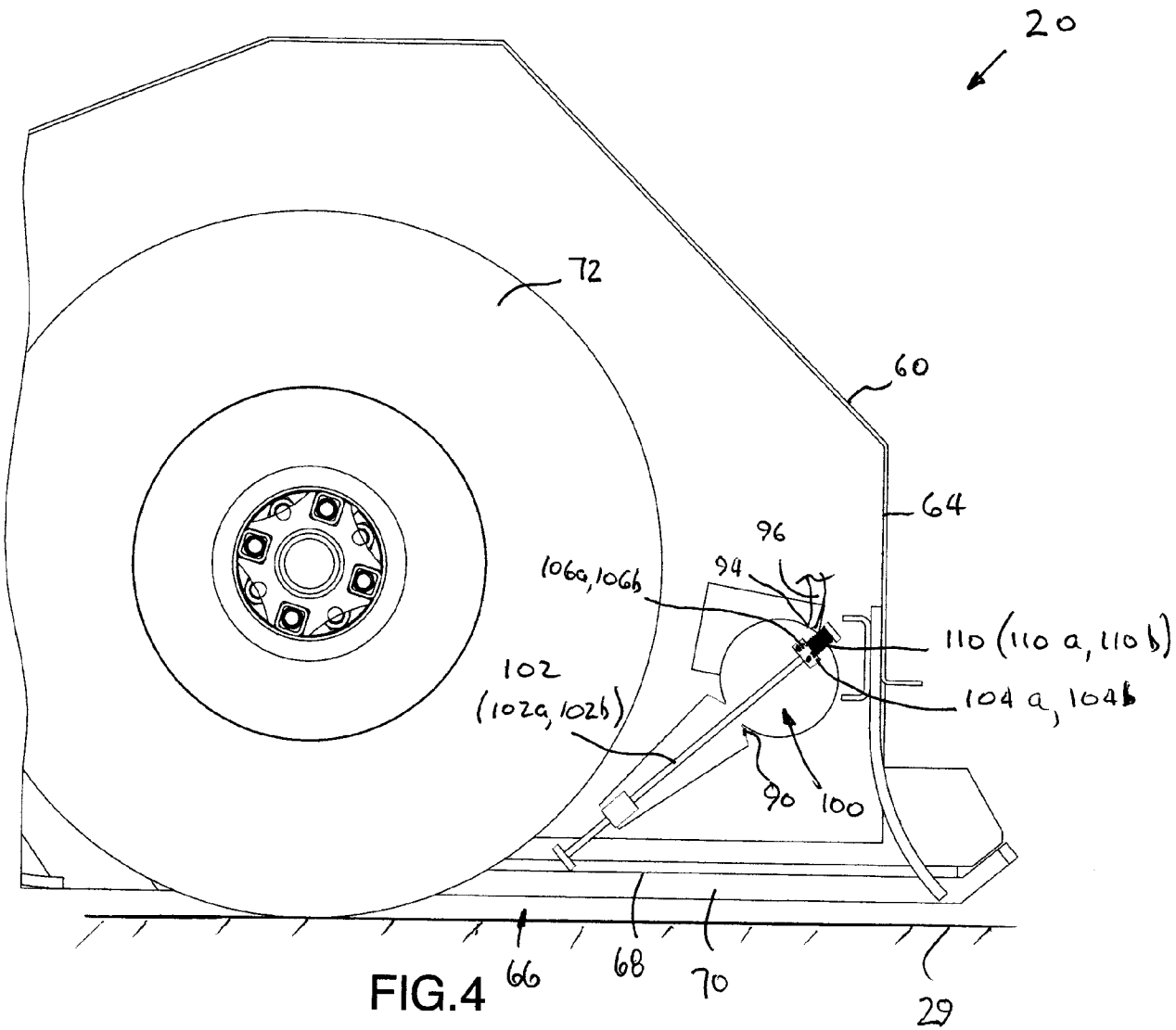

There is an air blast nozzle 90 mounted on the broom shroud 60 by a nozzle mounting means, as indicated by the general reference numeral 100, which is for mounting the air blast nozzle 90 for movement between a lower position, as is best seen in FIG. 3, and a raised impact-absorbing position, as is best seen in FIG. 4. In the lower position, the air blast nozzle 90 is disposed adjacent the surface being cleaned 29. Further, the air blast nozzle 90 is positioned to emit air in a forward and downward direction to impact on the surface being cleaned 29, thereby permitting the air blast nozzle to clean dust and small debris from the surface being cleaned 29. In its raised impact-absorbing position, the air blast nozzle 90 is positioned to ride above undulations in the surface being cleaned 29 and also ride over obstructions, such as rocks and the like. In this manner, the air blast nozzle 90 is generally precluded from being damaged by the surface being cleaned 29 or objects thereon.

In the preferred embodiment, as illustrated, the nozzle mounting means comprises a track means 102 operatively mounted on the broom shroud 60. More specifically, the track means 102 comprises a left track 102*a* and a right track 102*b*. The left track 102*a* is mounted on the left wall of the broom shroud 60 and the right track 102*b* is mounted on the right wall of the broom shroud 60. Strictly speaking, the right track 102*b* is hidden from view in figures by the left track 102*a*.

The nozzle mounting means further comprises a left bogie 104*a* operatively mounted for rolling engagement with the left track 102*a*, and also a right bogie 104*b* operatively mounted for rolling engagement with the right tract 102*b*. Wheels 106*a*, 106*b* on the left bogie 104*a* and the right bogie 104*b* permit the rolling engagement with the left track 102*a* and the right track 102*b*, respectively.

There is also a biassing means, as indicated by the general reference numeral 110, for biassing the air blast nozzle 90 to the lower position, so that the air blast nozzle 90 is adjacent the surface being cleaned. In the preferred embodiment as illustrated, the biassing means 110 for biassing the air blast nozzle 90 to the lowered position comprises at least one spring, and preferably comprises a left coil spring 110*a* operatively mounted on the broom shroud 60 at the left track 102*a*, and a right coil spring 110*b* operatively mounted on the broom shroud 60 at the right track 102*b*. The left coil spring 110*a* and the right coil spring 10*b* are in compression when the air blast nozzle is raised from its lowered position towards its raised position.

The air blast nozzle 90 has an outlet 92 aimed downwardly and forwardly so as to aim a blast of air at a surface being cleaned 29, and also has an inlet 94 connected in fluid communication via a flexible hose 96 to the outlet of the source of compressed air (the air re-circulation system) for receiving compressed air therefrom. The inlet 94 of the air blast nozzle 90 is of course in fluid communication with the outlet 92 of the air blast nozzle 90 to permit the ready flow of compressed air from the inlet 94 to the outlet 92.

In use, compressed air emanating from the outlet 92 of the air blast nozzle 90 is forcibly blasted against a surface being cleaned 29, preferably at the point of contact of the main sweeping broom 72 with the surface being cleaned 29.

In an alternative embodiment of the present invention, it is contemplated that the main sweeping broom could propel debris onto a debris elevator that then loads the received debris into a hopper.

As can be understood from the above description and from the accompanying drawings, the present invention provides a dustless sweeping broom apparatus wherein the air blast nozzle is independently suspended on the broom shroud so as to move upwardly in response to contact with the surface being cleaned, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the sweeping broom apparatus of the present invention without departing from the spirit and scope of the accompanying claims.

I claim:

1. A sweeping broom apparatus comprising:

a main body having a debris receiving inlet;

connecting means for operatively connecting said main body to a vehicle;

a broom shroud having a front end, a back end, an open bottom defined by a bottom edge, and a forwardly facing debris outlet for permitting the directed egress of debris therefrom as a forwardly propelled stream of debris;

means for mounting said broom shroud on said main body, for free vertical movement of said broom shroud with respect to said main body;

means for obstructing airflow disposed around the bottom edge of said broom shroud for substantially obstructing the egress of air from between the bottom edge of said broom shroud and the surface being cleaned;

a main sweeping broom mounted within said broom shroud for propelling debris forwardly from the surface being cleaned generally along said longitudinal horizontal axis, thereby creating a stream of debris propelled forwardly through said forwardly facing debris outlet;

an air blast nozzle connected in fluid communication to a source of compressed air for receiving compressed air therefrom;

nozzle mounting means for mounting said air blast nozzle for movement between a lower position whereat said air blast nozzle is disposed adjacent the surface being cleaned and to emit air in a forward and downward direction to impact on the surface being cleaned, and a raised impact-absorbing position; and, biasing means for biasing said air blast nozzle to said lower position.

2. The sweeping broom apparatus of claim 1, wherein said nozzle mounting means comprises a track operatively mounted on said broom shroud.

3. The sweeping broom apparatus of claim 1, wherein said track comprises a left track and a right track.

4. The sweeping broom apparatus of claim 3, wherein said nozzle mounting means further comprises a left bogie operatively mounted for rolling engagement with said left track and a right bogie operatively mounted for rolling engagement with said right track.

5. The sweeping broom apparatus of claim 3, wherein said biasing means for biasing said air blast nozzle to said lower position comprises a left coil spring operatively mounted on said broom shroud at said left track and a right coil spring operatively mounted on said broom shroud at said right track.

6. The sweeping broom apparatus of claim 1, wherein said biasing means for biasing said air blast nozzle to said lower position comprises at least one spring.

7. The sweeping broom apparatus of claim 1, wherein said means for obstructing airflow comprises a series of overlapping rubber flaps.

* * * * *